US011162374B2

(12) United States Patent
Taniguchi et al.

(10) Patent No.: US 11,162,374 B2
(45) Date of Patent: Nov. 2, 2021

(54) TURBINE NOZZLE AND AXIAL-FLOW TURBINE INCLUDING SAME

(71) Applicant: Mitsubishi Hitachi Power Systems, Ltd., Yokohama (JP)

(72) Inventors: Nao Taniguchi, Tokyo (JP); Ryo Takata, Tokyo (JP); Mitsuyoshi Tsuchiya, Yokohama (JP); Yu Shibata, Yokohama (JP)

(73) Assignee: MITSUBISHI POWER, LTD., Yokohama (JP)

( * ) Notice: Subject to any disclaimer, the term of this patent is extended or adjusted under 35 U.S.C. 154(b) by 18 days.

(21) Appl. No.: 16/631,025

(22) PCT Filed: Jul. 5, 2018

(86) PCT No.: PCT/JP2018/025434
§ 371 (c)(1),
(2) Date: Jan. 14, 2020

(87) PCT Pub. No.: WO2019/097757
PCT Pub. Date: May 23, 2019

(65) Prior Publication Data

US 2020/0182074 A1 Jun. 11, 2020

(30) Foreign Application Priority Data

Nov. 17, 2017 (JP) ..... JP2017-221824

(51) Int. Cl.
*F01D 9/02* (2006.01)
*F01D 5/14* (2006.01)

(52) U.S. Cl.
CPC ..... *F01D 9/02* (2013.01); *F01D 5/145* (2013.01); *F01D 5/147* (2013.01);
(Continued)

(58) Field of Classification Search
CPC . F01D 5/145; F01D 5/147; F01D 9/02; F01D 9/041; F05D 2220/31;
(Continued)

(56) References Cited

U.S. PATENT DOCUMENTS 4,545,197 A * 10/1985 Rice ..... F02C 6/18 60/775
5,035,578 A * 7/1991 Tran ..... F01D 5/141 416/223 A
(Continued)

FOREIGN PATENT DOCUMENTS

JP S61-232301 A 10/1986
JP H01-157202 U 10/1989
(Continued)

OTHER PUBLICATIONS

Notification Concerning Transmittal of International Preliminary Report on Patentability (Forms PCT/IB/326) issued in counterpart International Application No. PCT/JP2018/025434 dated May 28, 2020 with Forms PCT/IB/373, PCT/IB/338 and PCT/ISA/237. (18 pages).
(Continued)

*Primary Examiner* — Courtney D Heinle
*Assistant Examiner* — Danielle M. Christensen
(74) *Attorney, Agent, or Firm* — Westerman, Hattori, Daniels & Adrian, LLP

(57) ABSTRACT

A turbine nozzle includes a plurality of blades arranged so as to form a tapered flow passage between each two adjacent blades. A suction surface of each blade includes a curved surface, and a throat of the flow passage is formed between the curved surface of one blade and a trailing edge of the other blade of the two adjacent blades at a throat position. An upstream end of the curved surface is positioned upstream of
(Continued)

the throat position, and a downstream end of the curved surface is positioned downstream of the throat position.

7 Claims, 15 Drawing Sheets

(52) U.S. Cl.
CPC .... *F05D 2220/31* (2013.01); *F05D 2240/122* (2013.01); *F05D 2240/124* (2013.01); *F05D 2240/128* (2013.01); *F05D 2250/712* (2013.01); *F05D 2260/202* (2013.01)

(58) Field of Classification Search
CPC ..... F05D 2240/122; F05D 2240/124; F05D 2240/128; F05D 2250/712; F05D 2260/202
See application file for complete search history.

(56) References Cited

U.S. PATENT DOCUMENTS 5,228,833 A 7/1993 Schonenberger et al.
5,292,230 A 3/1994 Brown
6,358,012 B1 * 3/2002 Staubach ..... F01D 5/141 416/228
6,682,301 B2 * 1/2004 Kuhne ..... F01D 1/04 415/181
7,048,509 B2 * 5/2006 Tominaga ..... F01D 5/14 416/223 A
9,085,984 B2 * 7/2015 Ristau ..... F01D 5/141
2004/0202545 A1 10/2004 Senoo et al.

FOREIGN PATENT DOCUMENTS

JP H05-187202 A 7/1993
JP H09-125904 A 5/1997
JP 2000-045703 A 2/2000
JP 2006-329133 A 12/2006
JP 2016-166614 A 9/2016
WO 2003/033880 A1 4/2003

OTHER PUBLICATIONS

International Search Report dated Sep. 25, 2018, issued in counterpart application No. PCT/JP2018/025434, with English Translation. (12 pages).
Notification Concerning Transmittal of International Preliminary Report on Patentability (Forms PCT/IB/326) issued in counterpart International Application No. PCT/JP2018/025435 dated May 28, 2020 with Forms PCT/IB/373, PCT/IB/338 and PCT/ISA/237. (18 pages).
Office Action dated Feb. 4, 2020, issued in counterpart JP application No. 2017-221824, with English translation. (10 pages).

* cited by examiner

TURBINE NOZZLE AND AXIAL-FLOW TURBINE INCLUDING SAME

TECHNICAL FIELD

The present disclosure relates to a turbine nozzle and an axial-flow turbine including the same.

BACKGROUND ART

A conventional transonic turbine nozzle 100 includes a plurality of blades 102 arranged so as to form a tapered flow passage 101 between each two adjacent blades, as shown in FIG. 15. Between a suction surface 103 of one blade 102 and a trailing edge 104' of the other blade 102' adjacent to the blade 102, a throat 105 of the flow passage 101 is formed. The suction surface 103 of each blade 102 has a flat surface 107 extending flat from a throat position 106, at which the throat 105 is formed, to the trailing edge 104. As disclosed in Patent Documents 1 and 2, the blade element performance is typically affected by curvature of the suction surface and the throat position.

CITATION LIST

Patent Literature

Patent Document 1: JPS61-232301A
Patent Document 2: JP2016-166614A

SUMMARY

Problems to be Solved

Although there is a concern that a boundary layer developed on the suction surface causes the throat to shift toward the leading edge and thus reduces the blade element performance, neither Patent Documents 1 and 2 discloses a blade whose profile is designed in consideration of the influence of the boundary layer.

In view of the above circumstances, an object of at least one embodiment of the present disclosure is to provide a turbine nozzle and an axial-flow turbine including the same whereby it is possible to suppress the reduction in performance due to the influence of the boundary layer developed on the suction surface of the blade.

Solution to the Problems (1) A turbine nozzle according to at least one embodiment of the present disclosure comprises a plurality of blades arranged so as to form a tapered flow passage between each two adjacent blades. A suction surface of each blade includes a curved surface, and a throat of the flow passage is formed between the curved surface of one blade and a trailing edge of the other blade of the two adjacent blades at a throat position. An upstream end of the curved surface is positioned upstream of the throat position, and a downstream end of the curved surface is positioned downstream of the throat position.

With the above configuration (1), since the suction surface of each blade of the turbine nozzle has a curved surface at the throat position where the throat of the tapered flow passage between adjacent blades is formed, even if a boundary layer is formed on the suction surface, the flow passage area of the tapered flow passage is minimized at the throat position, so that the throat is prevented from shifting toward the leading edge. As a result, it is possible to suppress the reduction in turbine nozzle performance due to the influence of a boundary layer developed on the suction surface of the blade.

(2) In some embodiments, in the above configuration (1), the suction surface of each blade includes a flat surface extending flat from the downstream end of the curved surface to a trailing edge of the blade.

With the above configuration (2), since the flat surface extending flat from the downstream end of the curved surface to the trailing edge of the blade is provided, the occurrence of expansion wave due to curvature of the suction surface is suppressed, and thus the reduction in blade element performance in a transonic range is suppressed. As a result, it is possible to suppress the reduction in turbine nozzle performance due to the influence of a boundary layer developed on the suction surface of the blade.

(3) In some embodiments, in the above configuration (2), when L is a dimensionless axial chord length which is a ratio of a length from a leading edge of the blade in an axial direction to a length from the leading edge to the trailing edge of the blade in the axial direction, and AR(L) is a ratio of a flow passage area of the flow passage at a dimensionless axial chord length of L to a flow passage area of the flow passage at a dimensionless axial chord length of 1.0, the following expression is satisfied:

$$\left|\frac{AR(1.0) - AR(0.98)}{1.0 - 0.98}\right| \geqq 0.5 \qquad \text{(Expression 1)}$$

With the above configuration (3), since the absolute value of the flow-passage-area-ratio change rate in a dimensionless axial chord length range of 0.98 to 1.0 is equal to or greater than 0.5, even if a boundary layer is formed on the suction surface, a minimum flow passage area of the tapered flow passage is at the throat position. Thus, the throat is prevented from shifting toward the leading edge. As a result, it is possible to suppress the reduction in turbine nozzle performance due to the influence of a boundary layer developed on the suction surface of the blade.

(4) In some embodiments, in the above configuration (2) or (3), a suction-side deflection angle between the flat surface and a tangent plane to the curved surface at the throat position is equal to or less than 10°.

With the above configuration (4), since the suction-side deflection angle is equal to or less than 10°, the configuration (1) is achieved, so that the throat is prevented from shifting toward the leading edge. As a result, it is possible to suppress the reduction in turbine nozzle performance due to the influence of a boundary layer developed on the suction surface of the blade.

(5) In some embodiments, in any one of the above configurations (2) to (4), a trailing-edge included angle between two tangent planes at contact points of a trailing edge incircle with a pressure surface and the suction surface of the blade is equal to or greater than 3°, the trailing edge incircle being an incircle of minimum area touching the pressure surface and the suction surface.

With the above configuration (5), since the trailing-edge included angle is equal to or greater than 3°, the suction surface is shaped so as to protrude relative to the pressure surface, so that the flat surface can be easily formed, and the curved surface with a high curvature relative to the flat surface can be easily formed. As a result, the configuration (1) is achieved, and the throat is prevented from shifting toward the leading edge. In addition, the occurrence of expansion wave due to curvature of the suction surface is suppressed, and thus the reduction in blade element performance in a transonic range is suppressed. As a result, it is possible to suppress the reduction in turbine nozzle performance due to the influence of a boundary layer developed on the suction surface of the blade.

(6) In some embodiments, in the above configuration (1), the suction surface of each blade includes a first concave surface concavely curvedly extending from the downstream end of the curved surface to a trailing edge of the blade.

In a case where the turbine nozzle is used in a wetted area like a steam turbine, a liquid film may be formed on the suction surface of the blade. When the liquid film is formed on a flat surface, the surface may become uneven from the downstream end of the curved surface to the trailing edge, which may reduce the blade element performance in a transonic range. With the above configuration (6), since the first concave surface concavely curvedly extending from the downstream end of the curved surface to the trailing edge of the blade is provided, the liquid film is deposited on the first concave surface, and the surface of the liquid film forms a flat surface. Accordingly, the occurrence of expansion wave due to curvature of the suction surface is suppressed, and thus the reduction in blade element performance in a transonic range is suppressed. As a result, it is possible to suppress the reduction in performance of the turbine nozzle due to the influence of a liquid film formed on the suction surface of the blade.

(7) In some embodiments, in any one of the above configurations (1) to (6), the suction surface of each blade includes a second concave surface concavely curved between a leading edge and the throat position.

With the above configuration (7), since the second concave surface concavely curved between the leading edge and the throat position is provided, when a liquid film is formed on the suction surface, the liquid film is deposited on the second concave surface. Thus, the throat is prevented from shifting toward the leading edge by the liquid film deposited on the second concave surface. As a result, it is possible to suppress the reduction in performance of the turbine nozzle due to the influence of a liquid film formed on the suction surface of the blade.

(8) In some embodiments, in the above configuration (6), each blade includes a hub-side edge and a tip-side edge on both edges in a blade height direction, and the first concave surface has a depth decreasing from the hub-side edge toward a first boundary position away from the hub-side edge at a distance of 20% of a blade height in a direction from the hub-side edge toward the tip-side edge, between the first boundary position and the hub-side edge.

In a steam turbine, the liquid phase may be rolled up to the suction surface of the blade due to secondary flow and may cause additional moisture loss. With the above configuration (8), since the depth of the first concave surface decreases from the hub-side edge to the first boundary position, it is possible to prevent the liquid film from being drawn on the suction surface from the first concave surface toward the tip-side edge and reduce a secondary flow swirl. Thus, it is possible to reduce moisture loss.

(9) In some embodiments, in the above configuration (6), each blade includes a hub-side edge and a tip-side edge on both edges in a blade height direction, and the first concave surface has a depth increasing from a second boundary position away from the hub-side edge at a distance of 50% of a blade height in a direction from the hub-side edge toward the tip-side edge, toward the tip-side edge, between the second boundary position and the tip-side edge.

With the above configuration (9), since the depth of the first concave surface increases from the second boundary position toward the tip-side edge, when a liquid film formed on the suction surface flows to the first concave surface, the liquid film easily flows toward the tip-side edge and moves away from the blade as droplets. Since the droplets can be easily trapped by a drain catcher attached to the casing wall surface, it is possible to reduce drain attack erosion due to the droplets.

(10) In some embodiments, in the above configuration (7), each blade includes a hub-side edge and a tip-side edge on both edges in a blade height direction, and the second concave surface has a depth decreasing from the hub-side edge toward a first boundary position away from the hub-side edge at a distance of 20% of a blade height in a direction from the hub-side edge toward the tip-side edge, between the first boundary position and the hub-side edge.

With the above configuration (10), since the depth of the second concave surface decreases from the hub-side edge to the first boundary position, it is possible to prevent the liquid film from being drawn on the suction surface from the second concave surface toward the tip-side edge and reduce a secondary flow swirl. Thus, it is possible to reduce moisture loss.

(11) In some embodiments, in the above configuration (7), each blade includes a hub-side edge and a tip-side edge on both edges in a blade height direction, and the second concave surface has a depth increasing from a second boundary position away from the hub-side edge at a distance of 50% of a blade height in a direction from the hub-side edge toward the tip-side edge, toward the tip-side edge, between the second boundary position and the tip-side edge.

With the above configuration (11), since the depth of the second concave surface increases from the second boundary position toward the tip-side edge, when the liquid film formed on the suction surface flows to the second concave surface, the liquid film easily flows toward the tip-side edge and moves away from the blade as droplets. Since the droplets can be easily trapped by a drain catcher attached to the casing wall surface, it is possible to reduce drain attack erosion due to the droplets.

(12) A turbine nozzle according to at least one embodiment of the present disclosure comprises a plurality of blades arranged so as to form a tapered flow passage between each two adjacent blades. Each blade includes a hub-side edge and a tip-side edge on both edges in a blade height direction, a suction surface of each blade includes a concave surface concavely curved, and the concave surface has a depth increasing from a first boundary position away from the hub-side edge at a distance of 20% of a blade height in a direction from the hub-side edge toward the tip-side edge, toward the hub-side edge, between the first boundary position and the hub-side edge.

With the above configuration (12), since the depth of the concave surface decreases from the hub-side edge to the first boundary position, it is possible to prevent the liquid film from being drawn on the suction surface from the concave surface toward the tip-side edge and reduce a secondary flow swirl. Thus, it is possible to reduce moisture loss.

(13) A turbine nozzle according to at least one embodiment of the present disclosure comprises a plurality of blades arranged so as to form a tapered flow passage between each two adjacent blades. Each blade includes a hub-side edge and a tip-side edge on both edges in a blade height direction, a suction surface of each blade includes a concave surface concavely curved, and the concave surface has a depth increasing from a second boundary position away from the hub-side edge at a distance of 50% of a blade height in a direction from the hub-side edge toward the tip-side edge, toward the tip-side edge, between the second boundary position and the tip-side edge.

With the above configuration (13), since the depth of the concave surface increases from the second boundary position toward the tip-side edge, when the liquid film formed on the suction surface flows to the concave surface, the liquid film easily flows toward the tip-side edge and moves away from the blade as droplets. Since the droplets can be easily trapped by a drain catcher attached to the casing wall surface, it is possible to reduce drain attack erosion due to the droplets.

(14) An axial-flow turbine according to at least one embodiment of the present disclosure comprises: the turbine nozzle described in any one of the above (1) to (13).

With the above configuration (14), since the throat is prevented from shifting toward the leading edge, it is possible to suppress the reduction in performance due to the influence of a boundary layer developed on the suction surface of the blade.

Advantageous Effects

According to at least one embodiment of the present disclosure, since the suction surface of each blade of the turbine nozzle has a curved surface at the throat position where the throat of the tapered flow passage between adjacent blades is formed, even if a boundary layer is formed on the suction surface, the flow passage area of the tapered flow passage is minimized at the throat position, so that the throat is prevented from shifting toward the leading edge. As a result, it is possible to suppress the reduction in turbine nozzle performance due to the influence of a boundary layer developed on the suction surface of the blade.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

Embodiment 1

Figure 1:
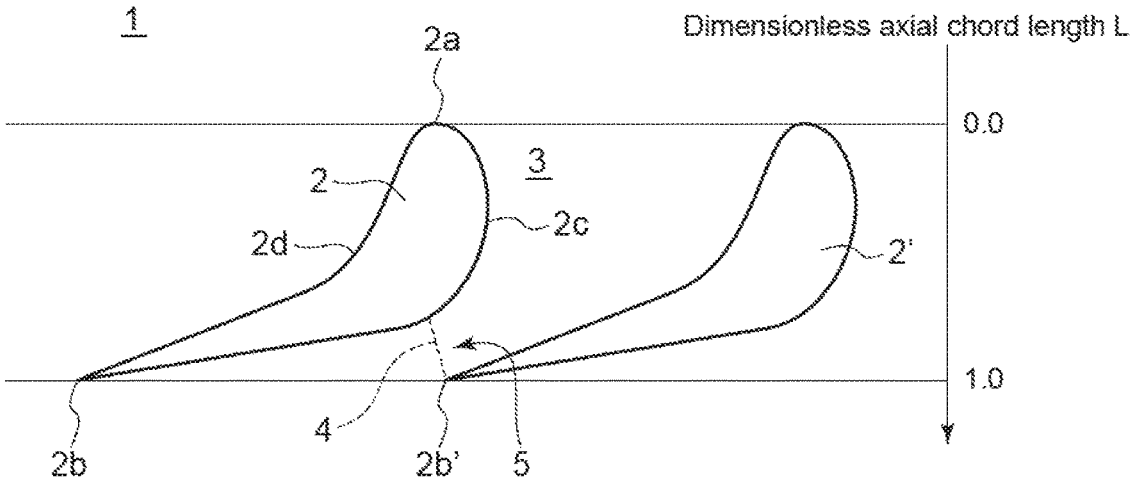
FIG. 1 is a schematic configuration diagram of a turbine nozzle according to a first embodiment of the present invention.

FIG. 1 shows a turbine nozzle 1 provided to an axial-flow turbine such as a steam turbine. The turbine nozzle 1 includes a plurality of blades 2. The plurality of blades 2 is arranged so as to form a flow passage 3 between adjacent blades 2'. The flow passage 3 has a tapered shape with a flow passage area gradually decreasing downstream, and a throat 4 having the minimum flow passage area is formed at a downstream end of the flow passage 3 by a suction surface 2*c* of one blade 2 and a trailing edge 2*b'* of the other blade 2' of two adjacent blades 2, 2'. A position at which the throat 4 is formed is referred to as a throat position 5.

Figure 2:
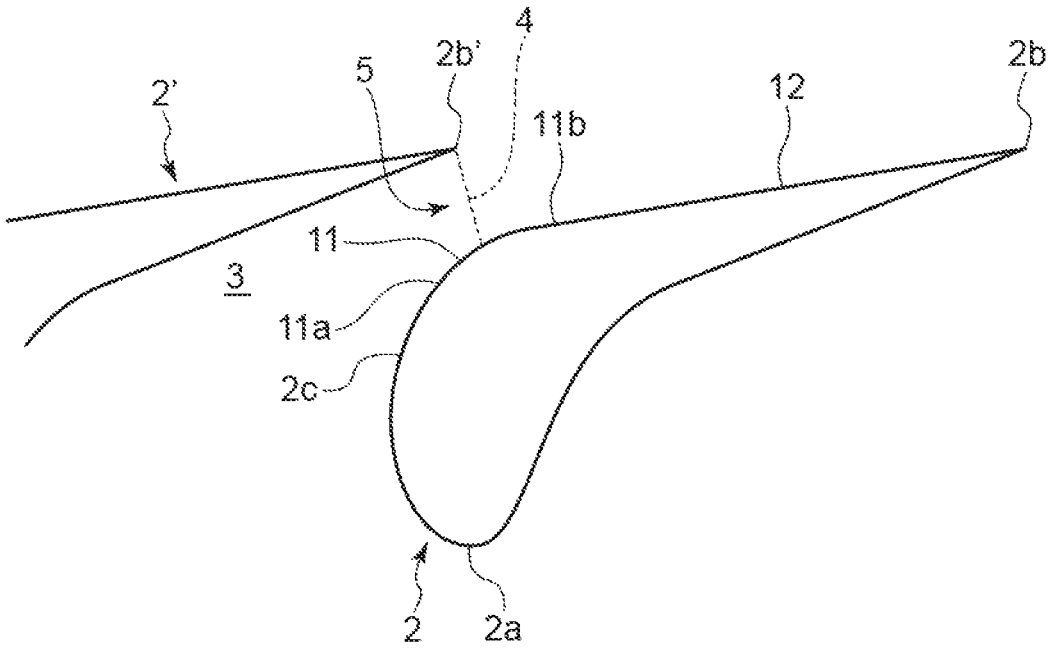
FIG. 2 is an enlarged view of a suction surface of a blade of a turbine nozzle according to the first embodiment of the present invention.

As shown in FIG. 2, the suction surface 2*c* of the blade 2 includes a curved surface 11 convexly curved toward the blade 2' adjacent to the blade 2 and a flat surface 12 extending flat from a downstream end 11*b* of the curved surface 11 to a trailing edge 2*b* of the blade 2. The curved surface 11 forms the throat 4 at the throat position 5 with the trailing edge 2*b'* of the blade 2' adjacent to the blade 2. An upstream end 11*a* of the curved surface 11 is positioned downstream of the throat position 5, and the downstream end 11*b* of the curved surface 11 is positioned downstream of the throat position 5. That is, the curved surface 11 extends both upstream and downstream of the throat position 5.

When a fluid flows through the flow passage 3, a boundary layer is formed on the suction surface 2*c*. In the first embodiment, however, since the curved surface 11 is provided at the throat position 5 at which the throat 4 of the flow passage 3 is formed, even if a boundary layer is formed on the suction surface 2*c*, the flow passage area of the flow passage 3 is minimized at the throat position 5. Accordingly, the throat 4 is prevented from shifting toward a leading edge 2*a*, and thus it is possible to suppress the reduction in performance of the turbine nozzle 1 (see FIG. 1) due to the influence of a boundary layer developed on the suction surface 2*c*.

Further, since the blade 2 has the flat surface 12 extending flat from the downstream end 11*b* of the curved surface 11 to the trailing edge 2*b*, the occurrence of expansion wave due to curvature of the suction surface 2*c* is suppressed, and thus the reduction in blade element performance in a transonic range is suppressed. As a result, it is possible to suppress the reduction in turbine nozzle performance due to the influence of a boundary layer developed on the suction surface 2*c* of the blade 2.

The blade 2 preferably has any of features described below to reliably achieve the configuration in which the suction surface 2*c* has the curved surface 11 and the flat surface 12.

As shown in FIG. 1, L ($0 \leq L \leq 1.0$) is a dimensionless axial chord length which is a ratio of a certain length from the leading edge 2*a* in the axial direction to a length from the leading edge 2*a* to the trailing edge 2*b* of the blade 2 in the axial direction. Further, AR(L) is a ratio of a flow passage area of the flow passage 3 at a dimensionless axial chord length of L to a flow passage area of the flow passage 3 at a dimensionless axial chord length of 1.0. The blade 2 has the following conditions of flow-passage-area-ratio change rate which is a change rate of the flow passage area ratio in a certain range of the dimensionless axial chord length.

$$\left|\frac{AR(1.0) - AR(0.98)}{1.0 - 0.98}\right| \geqq 0.5 \qquad \text{(Expression 2)}$$

Figure 3:
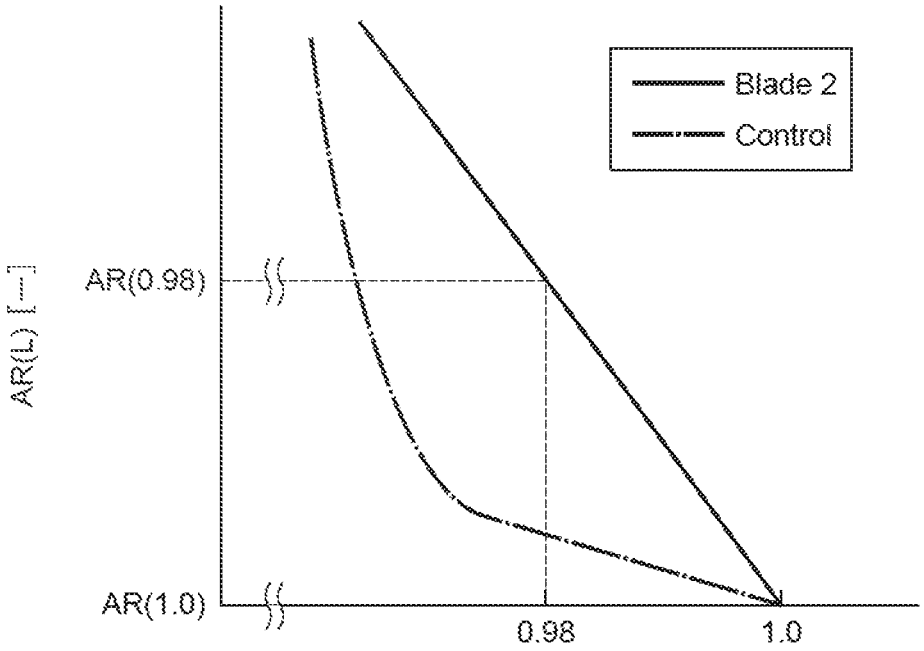
FIG. 3 is a graph showing a relationship between dimensionless axial chord length and ratio of flow passage area on a suction surface of a blade of a turbine nozzle according to the first embodiment of the present invention.

FIG. 3 is a graph of the change in the flow passage area ratio AR(L) in the vicinity of the trailing edge 2*b* of the blade 2 in the first embodiment. As a control, the change in the flow passage area ratio AR(L) of a turbine nozzle provided with blades having a lower change rate of AR(L) than the blade 2 is also shown. The difference in shape between these blades is that the flow passage area of the blade 2 in the vicinity of the throat position more greatly changes than that of the control.

Figure 4:
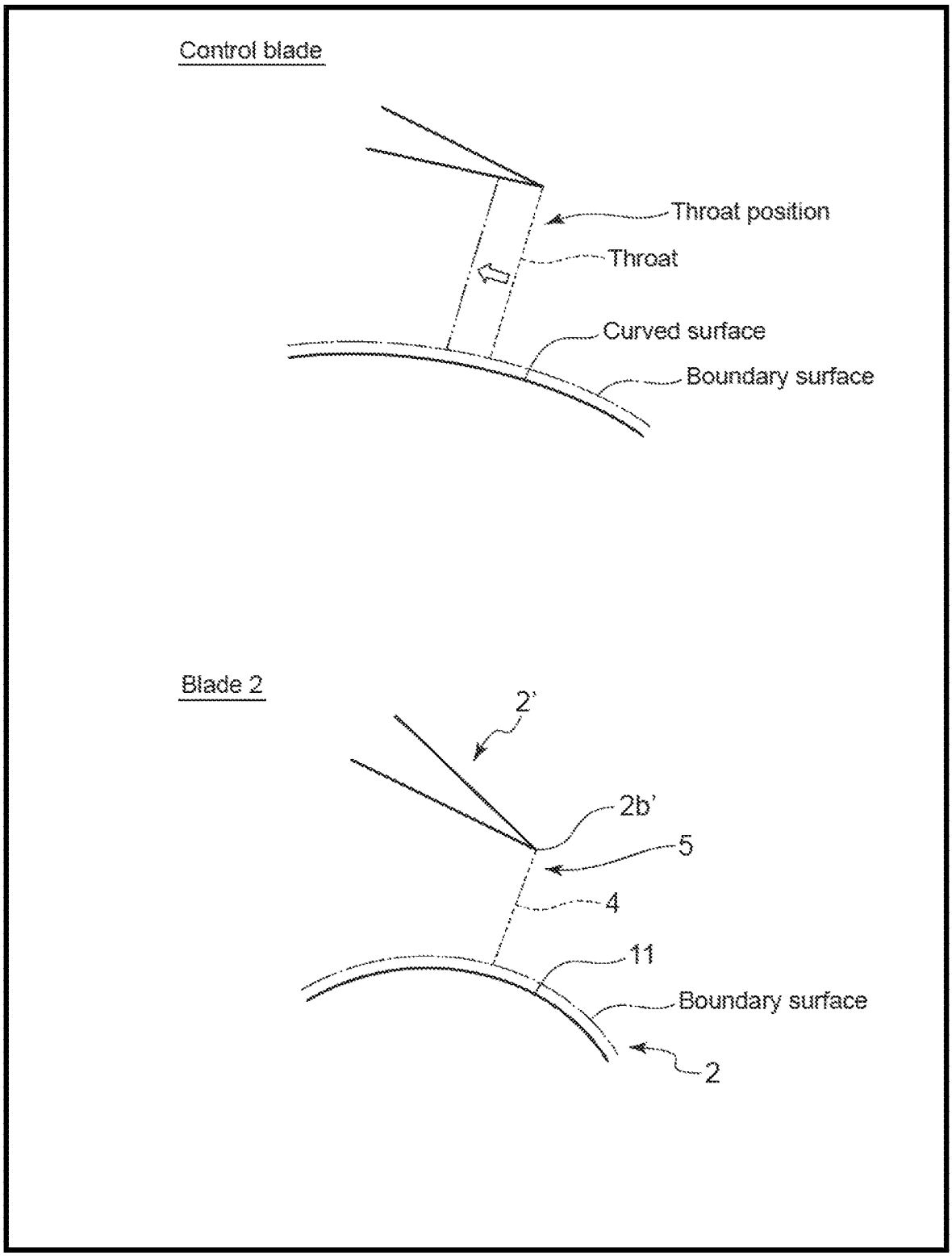
FIG. 4 is a schematic diagram for describing difference in operation and effect between blades having different flow-passage-area-ratio change rates.

As shown in FIG. 4, in the control blade having a flow-passage-area-ratio change rate of less than 0.5, the flow passage cross-sectional area less changes along the axial direction in the vicinity of the throat position. Thus, the control blade has a shape such that a portion of minimum flow passage area is easily shifted toward the leading edge, i.e., the throat is easily shifted toward the leading edge, when a boundary layer is formed on the suction surface of the blade. In contrast, in the blade 2, the flow passage cross-sectional area greatly changes along the axial direction in the vicinity of the throat position 5. Thus, the blade 2 has a shape such that a portion of minimum flow passage area is kept at the throat position 5, i.e., the throat is not easily shifted toward the leading edge, even when a boundary layer is formed on the suction surface. The blade 2 having this feature prevents the throat from shifting toward the leading edge 2*a* even when a boundary layer is formed on the suction surface 2*c*.

Figure 5:
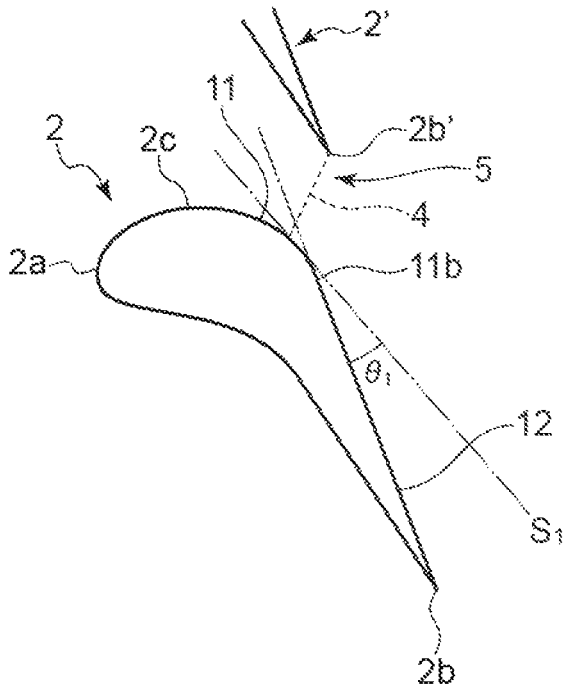
FIG. 5 is a diagram for describing the shape of a suction surface of a blade of a turbine nozzle according to the first embodiment of the present invention.
Figure 15:
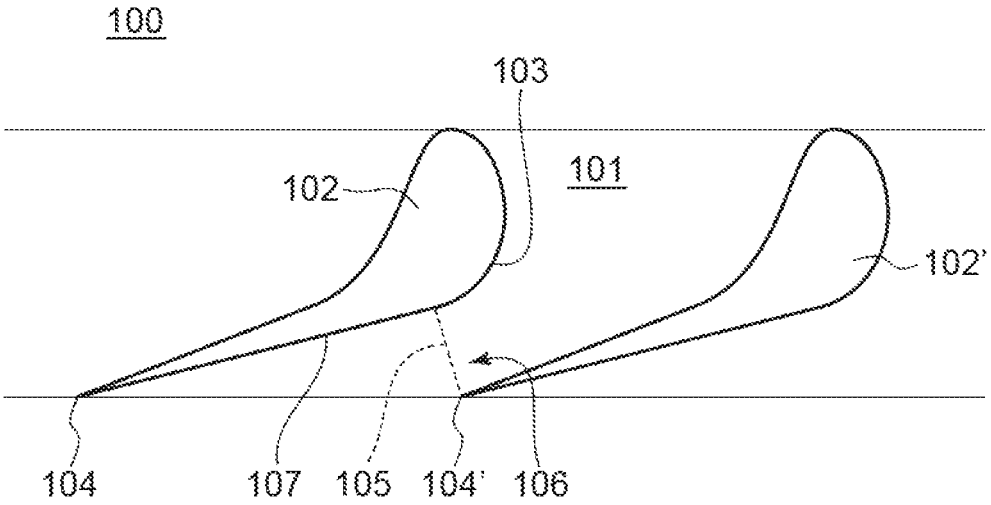
FIG. 15 is a schematic configuration diagram of a conventional turbine nozzle.

Further, as shown in FIG. 5, on the suction surface 2*c* of the blade 2, a suction-side deflection angle $\theta_1$ between the flat surface 12 and a tangent plane $S_1$ to the curved surface 11 at the throat position 5 satisfies $5° \theta_1 \leq 10°$. In the conventional blade (see FIG. 15) having a flat surface from the throat position 5 to the trailing edge 2*b*, the suction-side deflection angle $\theta_1$ is 0°. When the suction-side deflection angle is equal to or less than 10°, the configuration of FIG. 2 is achieved, so that the throat 4 is prevented from shifting toward the leading edge 2*a*.

Figure 6:
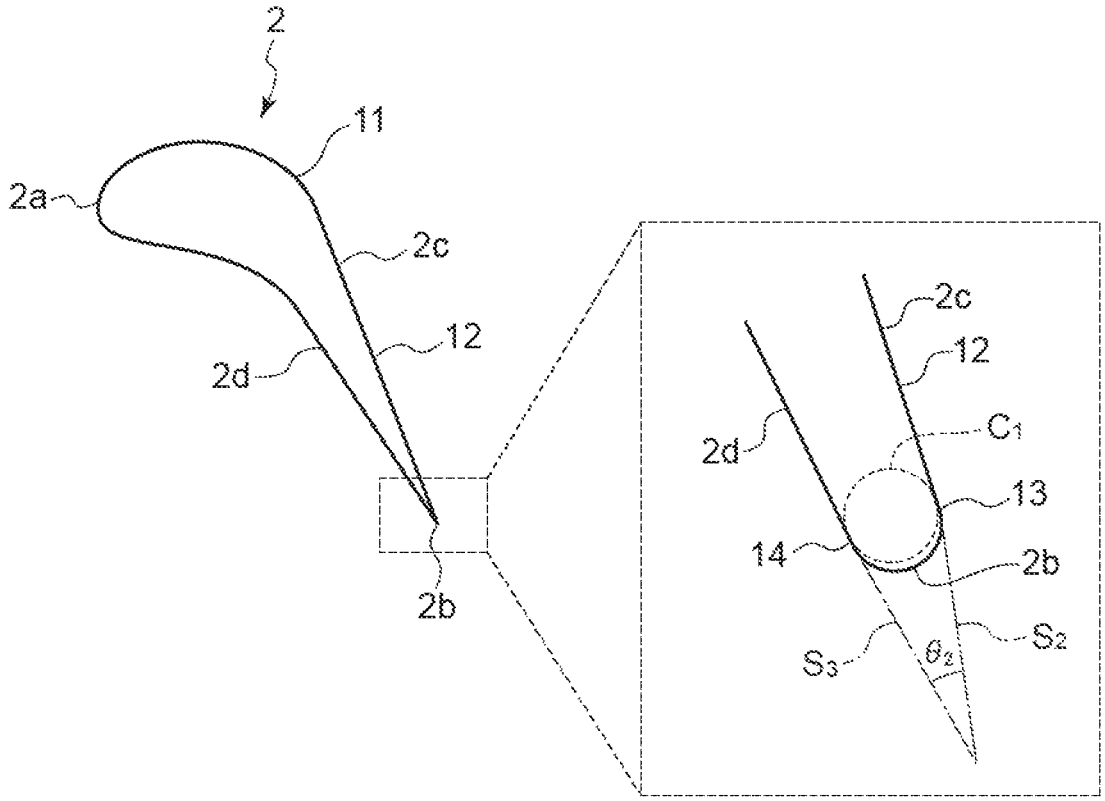
FIG. 6 is a diagram for describing the shape of a suction surface of a blade of a turbine nozzle according to the first embodiment of the present invention.

Further, as shown in FIG. 6, in the blade 2, a trailing-edge included angle $\theta_2$ between two tangent planes $S_2$ and $S_3$ at contact points 13 and 14 of a trailing edge incircle C1, which is an incircle of minimum area touching the suction surface 2*c* and the pressure surface 2*d* of the blade 2, with the suction surface 2*c* and the pressure surface 2*d* is equal to or greater than 3°. When the trailing-edge included angle 2*z* is equal to or greater than 3°, since the suction surface 2*c* is shaped so as to protrude relative to the pressure surface 2*d*, the flat surface 12 can be easily formed, and the curved surface 11 with a high curvature relative to the flat surface 12 can be easily formed. As a result, the configuration of FIG. 2 is achieved, and the throat 4 is prevented from shifting toward the leading edge 2*a*. In addition, the occurrence of expansion wave due to curvature of the suction surface 2*c* is suppressed, and thus the reduction in blade element performance in a transonic range is suppressed.

Thus, since the suction surface 2*c* of each blade 2 of the turbine nozzle 1 has the curved surface 11 at the throat position 5 forming the throat 4 of the tapered flow passage 3 between the blade 2 and its adjacent blade 2', even if a boundary layer is formed on the suction surface 2*c*, the flow passage area of the tapered flow passage 3 is minimized at the throat position 5, which prevents the throat 4 from shifting toward the leading edge 2*a*. As a result, it is possible to suppress the reduction in performance of the turbine nozzle 1 due to the influence of a boundary layer developed on the suction surface 2*c* of the blade 2.

Second Embodiment

Next, a turbine nozzle according to the second embodiment will be described. The turbine nozzle according to the second embodiment is different from the first embodiment in that the flat surface 12 is changed to a first concave surface concavely curved. In the second embodiment, the same constituent elements as those in the first embodiment are associated with the same reference numerals and not described again in detail.

Figure 7:
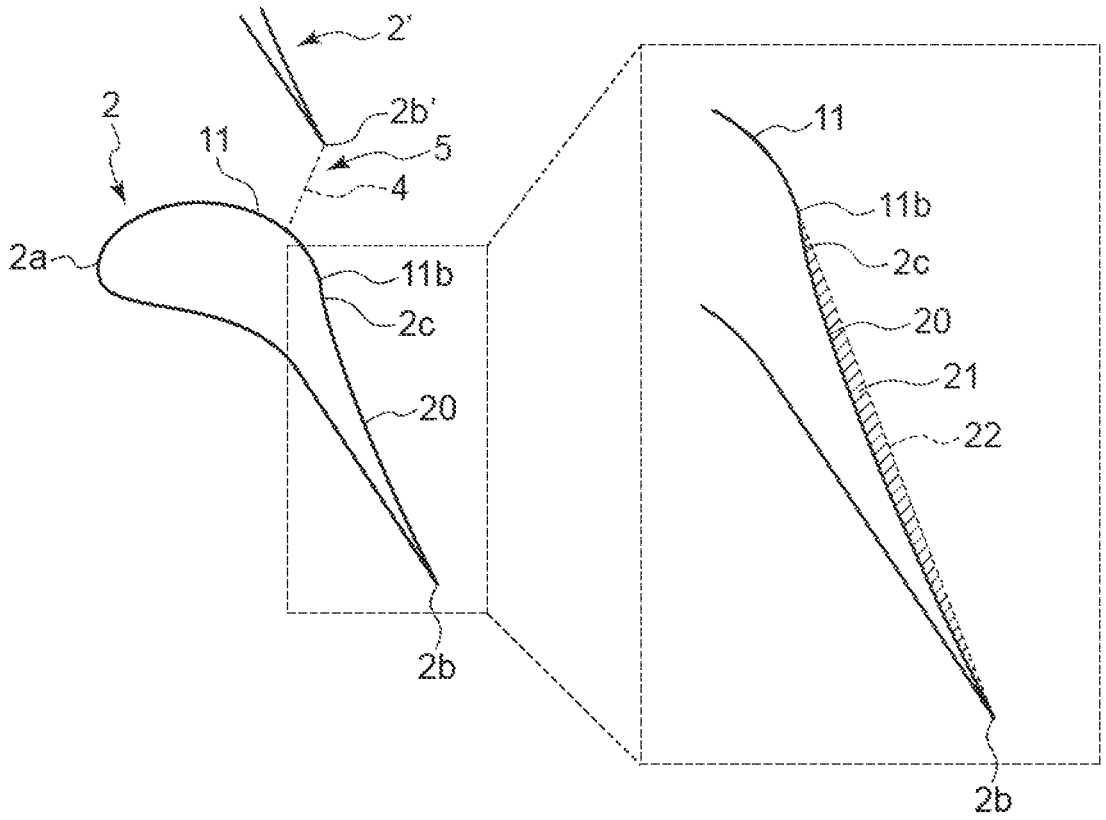
FIG. 7 is a diagram for describing the shape of a suction surface of a blade of a turbine nozzle according to a second embodiment of the present invention.

As shown in FIG. 7, the suction surface 2*c* of the blade 2 includes a concave surface 20 (first concave surface) concavely curved from the downstream end 11*b* of the curved surface 11 to the trailing edge 2*b* of the blade 2. The configuration is otherwise the same as that of the first embodiment.

In a case where the turbine nozzle 1 (see FIG. 1) is used in a wetted area like a steam turbine, a liquid film may be formed on the suction surface 2*c* of the blade 2. In the second embodiment, since the concave surface 20 concavely curvedly extending from the downstream end 11*b* of the curved surface 11 to the trailing edge 2*b* of the blade 2 is provided, a liquid film 21 is deposited on the concave surface 20. As a result, a surface 22 of the liquid film 21 on the concave surface forms a flat surface. When the surface 22 of the liquid film 21 forms the flat surface, the occurrence of expansion wave due to curvature of the suction surface 2*c* is suppressed, and thus the reduction in blade element performance in a transonic range is suppressed. As a result, it is possible to suppress the reduction in performance of the turbine nozzle 1 due to the influence of a liquid film formed on the suction surface 2*c* of the blade 2.

Third Embodiment

Next, a turbine nozzle according to the third embodiment will be described. The turbine nozzle according to the third embodiment is different from the first and second embodiments in that a second concave surface concavely curved is formed between the upstream end 11*a* of the curved surface 11 and the leading edge 2*a*. The following description will be given based on an embodiment, wherein, starting from the first embodiment, the second concave surface is formed. However, embodiments, wherein, starting from the second embodiment, the second concave surface is formed, i.e., both the first concave surface and the second concave surface are formed, are also possible. In the third embodiment, the same constituent elements as those in the first embodiment are associated with the same reference numerals and not described again in detail.

Figure 8:
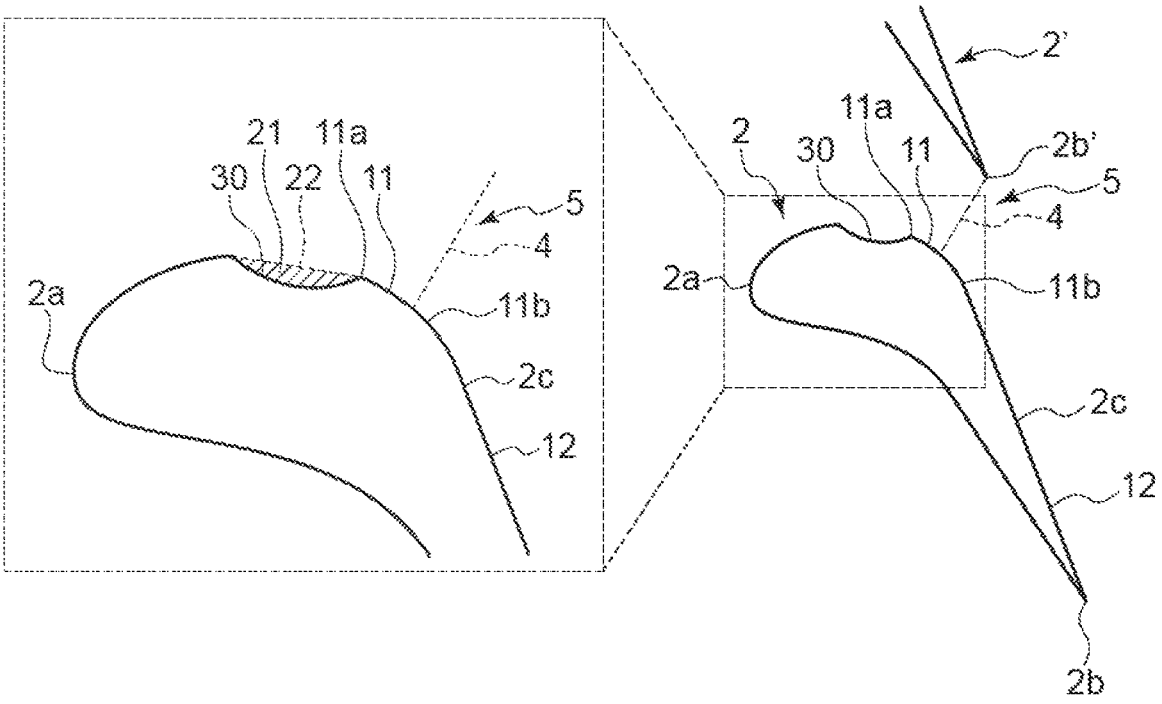
FIG. 8 is a diagram for describing the shape of a suction surface of a blade of a turbine nozzle according to a third embodiment of the present invention.

As shown in FIG. 8, the suction surface 2*c* of the blade 2 includes a concave surface 30 (second concave surface) concavely curved between the upstream end 11*a* of the curved surface 11 and the leading edge 2*a*. The configuration is otherwise the same as that of the first embodiment.

In the third embodiment, since the concave surface 30 is formed between the upstream end 11*a* of the curved surface 11 and the leading edge 2*a* on the suction surface 2*c*, i.e., between the throat position 5 and the leading edge 2*a*, a liquid film 21 formed on the suction surface 2*c* is deposited on the concave surface 30. As long as the concave surface 30 receives the liquid film 21, the surface 22 of the liquid film 21 does not protrude toward the adjacent blade 2' from the curved surface 11, so that the flow passage area of the flow passage 3 at the throat position 5 is still minimum. Thus, the throat 4 is prevented from shifting toward the leading edge 2*a*. As a result, it is possible to suppress the reduction in performance of the turbine nozzle 1 due to the influence of a liquid film formed on the suction surface 2*c* of the blade 2.

In the second and third embodiments, the curved surface 11 is formed on the suction surface 2*c* of the blade 2 as well as the first embodiment. Therefore, the second and third embodiments likewise have the effect of preventing shifting of the throat 4 toward the leading edge 2*a* due to formation of a liquid film.

Fourth Embodiment

Next, a turbine nozzle according to the fourth embodiment will be described. The turbine nozzle according to the fourth embodiment is different from the second embodiment in that the configuration of the first concave surface is modified. In the fourth embodiment, the same constituent elements as those in the second embodiment are associated with the same reference numerals and not described again in detail.

Figure 9:
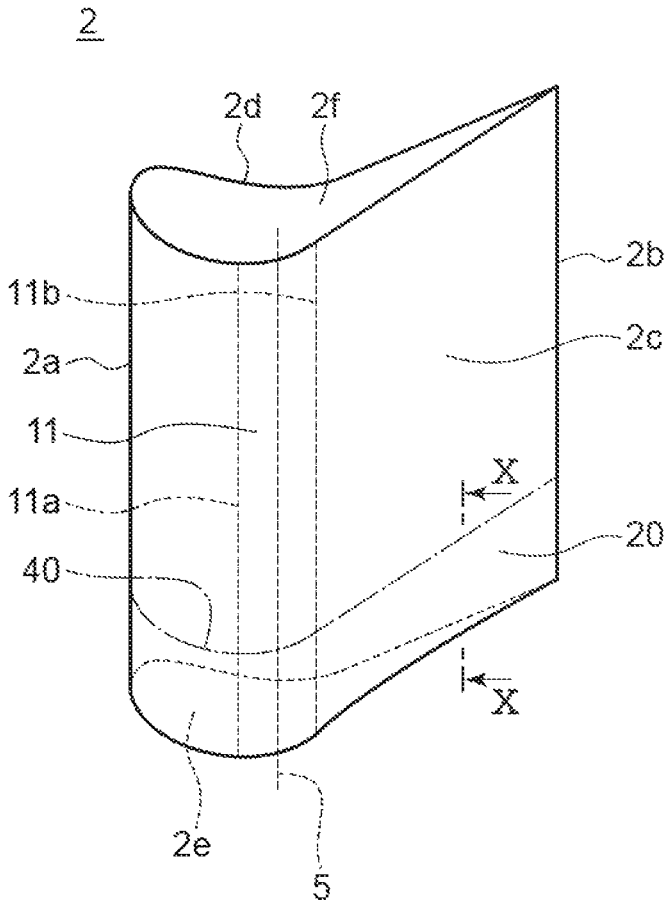
FIG. 9 is a diagram for describing the shape of a suction surface of a blade of a turbine nozzle according to a fourth embodiment of the present invention.
Figure 10:
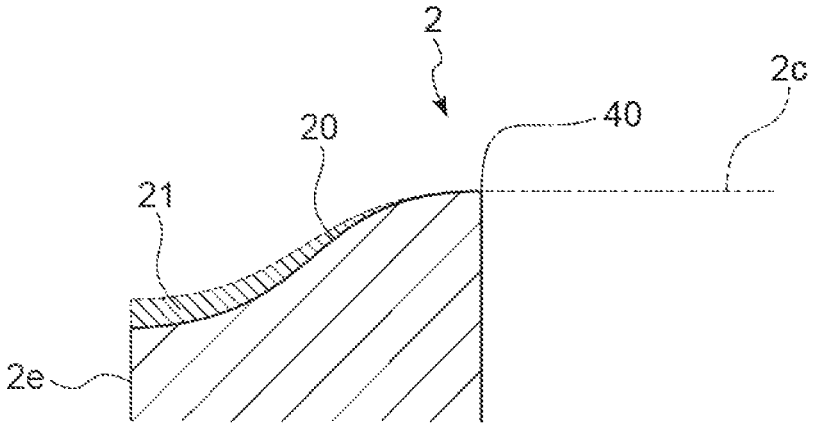
FIG. 10 is a cross-sectional view taken along line X-X in FIG. 9.

As shown in FIG. 9, the blade 2 includes a hub-side edge 2*e* and a tip-side edge 2*f* on both edges in the blade thickness direction. The suction surface 2*c* of the blade 2 has a concave surface 20 between the hub-side edge 2*e* and a first boundary position 40 away from the hub-side edge 2*e* at a distance of 20% of the blade thickness in a direction from the hub-side edge 2*e* toward the tip-side edge 2*f*. As shown in FIG. 10, the concave surface 20 has a depth decreasing from the hub-side edge 2*e* toward the first boundary position 40. The configuration is otherwise the same as that of the second embodiment.

In a steam turbine, as described in the second embodiment, the liquid film 21 may be formed on the suction surface 2*c*. The liquid film 21 may be rolled up to the suction surface 2*c* of the blade 2 due to secondary flow, which may cause additional moisture loss. In the fourth embodiment, since the depth of the concave surface 20 decreases from the hub-side edge 2*e* to the first boundary position 40, it is possible to prevent the liquid film 21 from being drawn on the suction surface 2*c* from the concave surface 20 toward the tip-side edge 2*f* (see FIG. 9) and reduce a secondary flow swirl. Thus, it is possible to reduce moisture loss.

Fifth Embodiment

Next, a turbine nozzle according to the fifth embodiment will be described. The turbine nozzle according to the fifth embodiment is different from the third embodiment in that the configuration of the second concave surface is modified. In the fifth embodiment, the same constituent elements as those in the third embodiment are associated with the same reference numerals and not described again in detail.

Figure 11:
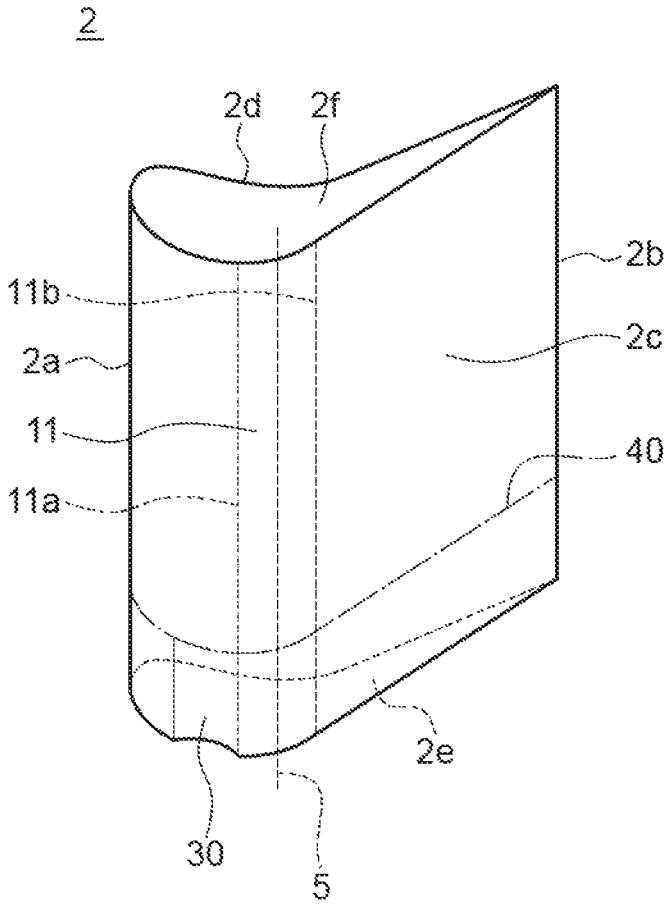
FIG. 11 is a diagram for describing the shape of a suction surface of a blade of a turbine nozzle according to a fifth embodiment of the present invention.

As shown in FIG. 11, the blade 2 includes a hub-side edge 2*e* and a tip-side edge 2*f* on both side in the blade thickness direction. The suction surface 2*c* of the blade 2 has a concave surface 30 between the hub-side edge 2*e* and a first boundary position 40 away from the hub-side edge 2*e* at a distance of 20% of the blade thickness in a direction from the hub-side edge 2*e* toward the tip-side edge 2*f*. The concave surface 30 has a depth decreasing from the hub-side edge 2*e* toward the first boundary position 40, as with the concave surface 20 in the fourth embodiment. The configuration is otherwise the same as that of the third embodiment.

In the fifth embodiment, similarly, since the depth of the concave surface 30 decreases from the hub-side edge 2*e* to the first boundary position 40, it is possible to prevent the liquid film 21 (see FIG. 8) from being drawn on the suction surface 2*c* from the concave surface 30 toward the tip-side edge 2*f* (see FIG. 9) and reduce a secondary flow swirl. Thus, it is possible to reduce moisture loss.

Sixth Embodiment

Next, a turbine nozzle according to the sixth embodiment will be described. The turbine nozzle according to the sixth embodiment is different from the second embodiment in that the configuration of the first concave surface is modified. In the sixth embodiment, the same constituent elements as those in the second embodiment are associated with the same reference numerals and not described again in detail.

Figure 12:
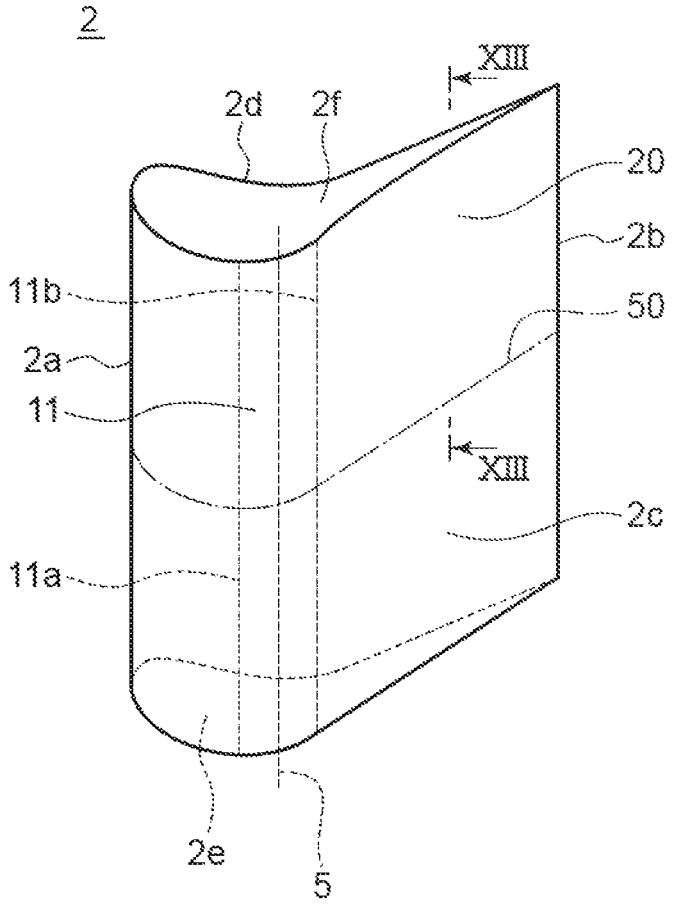
FIG. 12 is a diagram for describing the shape of a suction surface of a blade of a turbine nozzle according to a sixth embodiment of the present invention.
Figure 13:
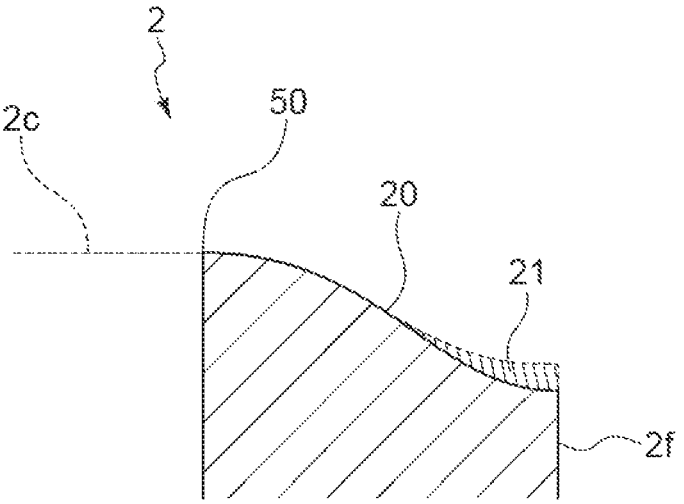
FIG. 13 is a cross-sectional view taken along line XIII-XIII in FIG. 12.

As shown in FIG. 12, the blade 2 includes a hub-side edge 2*e* and a tip-side edge 2*f* on both side in the blade thickness direction. The suction surface 2*c* of the blade 2 has a concave surface 20 between the tip-side edge 2*f* and a second boundary position 50 away from the hub-side edge 2*e* at a distance of 50% of the blade thickness in a direction from the hub-side edge 2*e* toward the tip-side edge 2*f*. As shown in FIG. 13, the concave surface 20 has a depth increasing from the second boundary position 50 toward the tip-side edge 2*f*. The configuration is otherwise the same as that of the second embodiment.

In a steam turbine, as described in the second embodiment, the liquid film 21 may be formed on the suction surface 2*c*. During operation of the steam turbine, the liquid film 21 may break into droplets away from the blade 2. The droplets may cause drain attack erosion in the steam turbine. In the sixth embodiment, since the depth of the concave surface 20 increases from the second boundary position 50 toward the tip-side edge 2*f*, when the liquid film 21 formed on the suction surface 2*c* flows to the concave surface 20, the liquid film 21 easily flows toward the tip-side edge 2*f* and moves away from the blade 2 as droplets. By providing a drain catcher on the casing wall surface, the droplets can be trapped by the drain catcher, which reduces drain attack erosion due to the droplets.

Seventh Embodiment

Next, a turbine nozzle according to the seventh embodiment will be described. The turbine nozzle according to the seventh embodiment is different from the third embodiment in that the configuration of the second concave surface is modified. In the seventh embodiment, the same constituent elements as those in the third embodiment are associated with the same reference numerals and not described again in detail.

Figure 14:
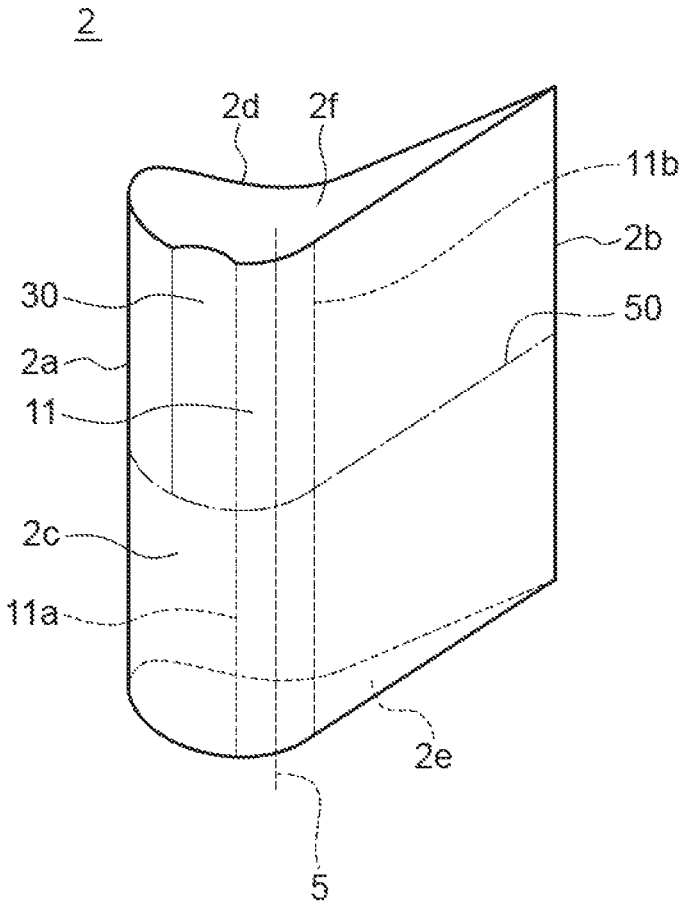
FIG. 14 is a diagram for describing the shape of a suction surface of a blade of a turbine nozzle according to a seventh embodiment of the present invention.

As shown in FIG. 14, the blade 2 includes a hub-side edge 2*e* and a tip-side edge 2*f* on both side in the blade thickness direction. The suction surface 2*c* of the blade 2 has a concave surface 30 between the tip-side edge 2*f* and a second boundary position 50 away from the hub-side edge 2*e* at a distance of 50% of the blade thickness in a direction from the hub-side edge 2*e* toward the tip-side edge 2*f*. The concave surface 30 has a depth increasing from the second boundary position 50 toward the tip-side edge 2*f*, as with the concave surface 20 in the sixth embodiment. The configuration is otherwise the same as that of the third embodiment.

In the seventh embodiment, similarly, since the depth of the concave surface 30 increases from the second boundary position 50 toward the tip-side edge 2*f*, when the liquid film 21 formed on the suction surface 2*c* flows to the concave surface 30, the liquid film 21 easily flows toward the tip-side edge 2*f* and moves away from the blade 2 as droplets. By providing a drain catcher on the casing wall surface, the droplets can be trapped by the drain catcher, which reduces drain attack erosion due to the droplets.

Although in the fourth and sixth embodiments, only the concave surface 20 is formed on the suction surface 2*c*, and in the fifth and seventh embodiments, only the concave surface 30 is formed on the suction surface 2*c*, the present invention is not limited to these embodiments. Both the concave surface 20 in the fourth and sixth embodiments and the concave surface 30 in the fifth and seventh embodiments may be formed on the suction surface 2*c*.

Although in the fourth to seventh embodiments, the configuration of the first embodiment is included, i.e., the suction surface 2*c* has the curved surface 11, the present invention is not limited to these embodiments. At least one of the concave surface 20 in the fourth and sixth embodiments or the concave surface 30 in the fifth and seventh embodiments may be formed on the suction surface 2*c* not having the curved surface 11 in the first embodiment.

REFERENCE SIGNS LIST

1 Turbine nozzle
2 Blade
2*a* Leading edge (of blade)
2*b* Trailing edge (of blade)
2*c* Suction surface (of blade)
2*d* Pressure surface (of blade)
2*e* Hub-side edge (of blade)
2*f* Tip-side edge (of blade)
3 Flow passage
4 Throat
5 Throat position
11 Curved surface
11*a* Upstream end (of curved surface)
11*b* Downstream end (of curved surface)
12 Flat surface
13 Contact point
14 Contact point
20 Concave surface (First concave surface)
21 Liquid film
22 Surface (of liquid film)
30 Concave surface (Second concave surface)
40 First boundary position
50 Second boundary position
$C_1$ Trailing edge incircle
L Dimensionless axial chord length
$S_1$ Tangent plane
$S_2$ Tangent plane
$S_3$ Tangent plane
$\theta_1$ Suction-side deflection angle
$\theta_2$ Trailing-edge included angle

The invention claimed is:

1. A turbine nozzle comprising a plurality of blades arranged so as to form a tapered flow passage between each two adjacent blades, wherein a suction surface of each blade includes a curved surface, and a throat of the flow passage is formed between the curved surface of one blade and a trailing edge of the other blade of the two adjacent blades at a throat position:

wherein an upstream end of the curved surface is positioned upstream of the throat position, and a downstream end of the curved surface is positioned downstream of the throat position, wherein the suction surface of each blade includes a flat surface extending flat from the downstream end of the curved surface to a trailing edge of the blade, and wherein when L is a dimensionless axial chord length which is a ratio of a length from a leading edge of the blade in an axial direction to a length from the leading edge to the trailing edge of the blade in the axial direction, and AR(L) is a ratio of a flow passage area of the flow passage at a dimensionless axial chord length of L to a flow passage area of the flow passage at a dimensionless axial chord length of 1.0, the following expression is satisfied:

$$\left|\frac{AR(1.0) - AR(0.98)}{1.0 - 0.98}\right| \geqq 0.5.$$

2. The turbine nozzle according to claim 1, wherein a suction-side deflection angle between the flat surface and a tangent plane to the curved surface at the throat position is equal to or less than 10°.

3. The turbine nozzle according to claim 1, wherein a trailing-edge included angle between two tangent planes at contact points of a trailing edge incircle with a pressure surface and the suction surface of the blade is equal to or greater than 3°, the trailing edge incircle being an incircle of minimum area touching the pressure surface and the suction surface.

4. The turbine nozzle according to claim 1, wherein the suction surface of each blade includes a second concave surface concavely curved between a leading edge and the throat position.

5. The turbine nozzle according to claim 4, wherein each blade includes a hub-side edge and a tip-side edge on both edges in a blade height direction, and wherein the second concave surface has a depth decreasing from the hub-side edge toward a first boundary position away from the hub-side edge at a distance of 20% of a blade height in a direction from the hub-side edge toward the tip-side edge, between the first boundary position and the hub-side edge.

6. The turbine nozzle according to claim 4, wherein each blade includes a hub-side edge and a tip-side edge on both edges in a blade height direction, and wherein the second concave surface has a depth increasing from a second boundary position away from the hub-side edge at a distance of 50% of a blade height in a direction from the hub-side edge toward the tip-side edge, toward the tip-side edge, between the second boundary position and the tip-side edge.

7. An axial-flow turbine comprising the turbine nozzle according to claim 1.

* * * * *